United States Patent [19]

Thornton

[11] Patent Number: 4,819,701

[45] Date of Patent: Apr. 11, 1989

[54] PORTABLE PARTICULATE MATERIAL BAGGING MACHINE

[76] Inventor: C. J. Thornton, 4452 Rogers Ln., Clarmore, Okla. 74017

[21] Appl. No.: 123,541

[22] Filed: Nov. 20, 1987

[51] Int. Cl.[4] ..... B65B 1/00

[52] U.S. Cl. ..... 141/231; 141/313

[58] Field of Search ..... 141/10, 231, 114, 313, 141/314; 414/471, 481

[56] References Cited

U.S. PATENT DOCUMENTS

| | | | |
|---|---|---|---|
| 2,988,368 | 6/1961 | Kerr | 414/528 |
| 3,552,346 | 1/1971 | Garden | 141/313 |
| 4,585,041 | 4/1986 | Cavanagh | 141/231 |

*Primary Examiner*—William A. Cuchlinski, Jr.

*Attorney, Agent, or Firm*—Richard C. Litman

[57] ABSTRACT

A portable material bagging machine having a hopper superstructure deployed directly over a chain conveyor that is positioned in the floor of the hopper. The hopper superstructure is mounted on a dual set of wheels to maintain a center of gravity of the device so that a front mounted carriage adjustment stand may be actuated to selectively alter the level of the hopper superstructure to shift clumped sand within the hopper and deposit same onto a chute for subsequent loading onto the chain conveyor and thence to exit the one man bagging apparatus. The bagging device being of a small caliber to facilitate the handling by one operator of all necessary operations attended upon the delivery of bulk particulate materials to a site.

7 Claims, 1 Drawing Sheet

PORTABLE PARTICULATE MATERIAL BAGGING MACHINE

FIELD OF INVENTION

This apparatus relates to portable means for bagging sand and, more particularly to an apparatus providing for a single worker operation in the delivery and handling of bulk particulate materials for the quick and expeditious filling of sand bags.

BACKGROUND TO THE INVENTION

In times of emergency time and manpower is critical. Often having the right equipment and trained personnel make essential differences in reaction time and a minimizing of damage to property and loss of life.

The instant invention relates to equipment for the filling of sand bags in situations threatened flood or other disasters in which such bags filled with particulate materials are used to divert water or other liquids from property.

Specifically, this invention relates to a portable means for the filling of sand bags by a single operator, who may tow the device with a quantity of bulk sand or materials to a site and readily set up the operation, and who may in lieu of any help proceed single-handedly with the process of filling bags.

This apparatus also relates to ergonomically designed equipment in which the device is designed to aid the operator, to elevate the discharge means to a point whereby the operator doesn't suffer continual back strain in the bag filling process.

Often when flood threatens, there is a need for deployment of sand bagging equipment at a number of different locations; however, conventionally one large truck often must dump bulk sand at one location and then proceed to the next.

At each stop a crew awaits with bags to begin the filling process. This conventional approach moves only as quickly as large pieces of machinery and trucks moves to provide the necessary materials for the sand bagging operation to commence.

By providing a smaller, portable device for the bagging of sand and other materials, the instant invention makes possible a much shortened, faster reaction time and further, by deploying a number of such devices, the sand bagging operation is not only undertaken in an improved reaction time, but the smaller size of the device makes possible the econometrically factored adjustments of operation that enhance the utility of the device.

DESCRIPTION OF THE PRIOR ART

The following cited prior art references are found to be exemplary of the U.S. prior art. They are:

| U.S. Pat. No. | Inventor |
|---|---|
| 2,965,379 | Ganley |
| 2,988,368 | Kerr |
| 4.462.747 | Caplis |

U.S. Pat. No. 2,965,379, issued to Ganley, discloses a hopper for distributing finely divided materials. It includes a hopper with a bottom shutter whose position is adjustable by means of a lever and an endless conveyer mounted within the hopper; said conveyor incorporating sprockets and a chain. The assembly is mounted on a wheeled chassis suitable for pulling by a tractor.

U.S. Pat. No. 2,988,368, to Kerr, teaches a construction of a sanding mechanism. It contains a hopper adapted to be loaded with sand with an opening at the bottom. A reversible conveyer running underneath the hopper is run by a hydraulic motor. A pair of chutes direct the sand downwardly toward the road.

U.S. Pat. No. 4,462,747, issued to Caplis, discloses a conveyer assembly for use with a backhoe. A hopper empties material onto a conveyer belt. The conveyer empties the material into the buck of the backhoe. The conveyer is driven by a hydraulic motor. None of the prior art whether taken singularly or in combination disclose the specific features of the present invention so as to bear upon the claims as appended hereto.

SUMMARY OF THE INVENTION

An object of the invention is to provide means for the single operation of delivery, setup and operation of sand bagging equipment. By providing for a smaller size of conveyance, the device is econometrically configured to adapt to the needs of both a fast reaction time, as needed, and to establishing minimal manpower needs for operation.

Another object is to provide means for towing the device so that a variety of trucks may be employed to deploy the apparatus where needed and further, as a function of econometrical design and function, to provide a carriage adjustment stand that stabilizes hopper superstructure and additionally is used by the operator to slightly adjust the vertical angle of the hopper to assist in moving bulk materials through the unit.

Another object of the invention is to provide a powertrain that, in accordance with the size and function of the unit, is easy to maintain. The engine being matched in horsepower matched to the size of the hopper and to the time and rate of operation so that operation continues, without interruption while bulk material remains in the hopper. These and other objects and advantages of the present invention will be readily apparent in the specification as is hereinafter disclosed.

DESCRIPTION OF THE PREFERRED EMBODIMENT

Figure 1:
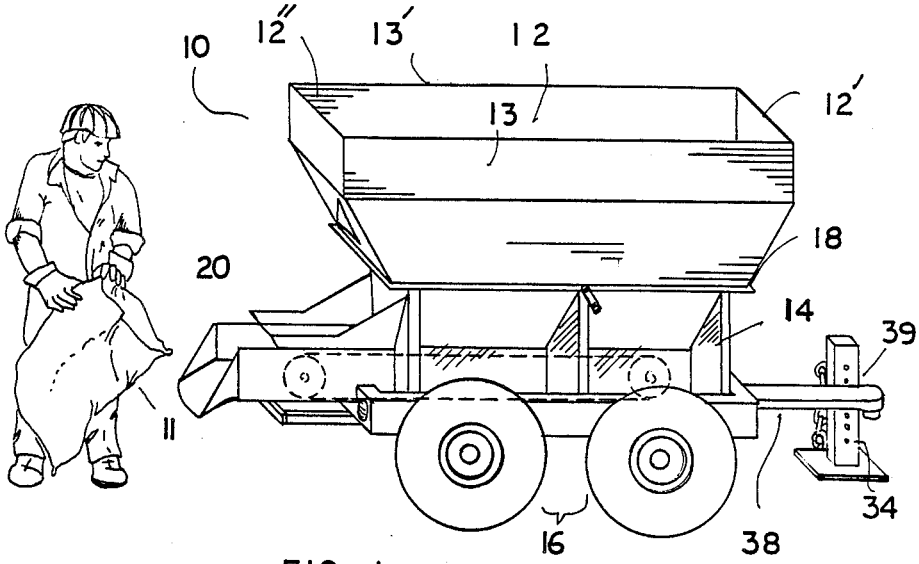
FIG. 1 is a elevational view of the device in use.

Referring now to the drawings in which like numerals refer to like elements throughout, the device 10 as shown in FIG. 1 includes a hopper superstructure 12 overlying and rigidly affixed and mounted to a wheeled carriage 14. Hopper superstructure 12 being substantially centered over a set of dual tandem wheels 16 so as to maintain a low, positive center of gravity of the device.

Figure 2:
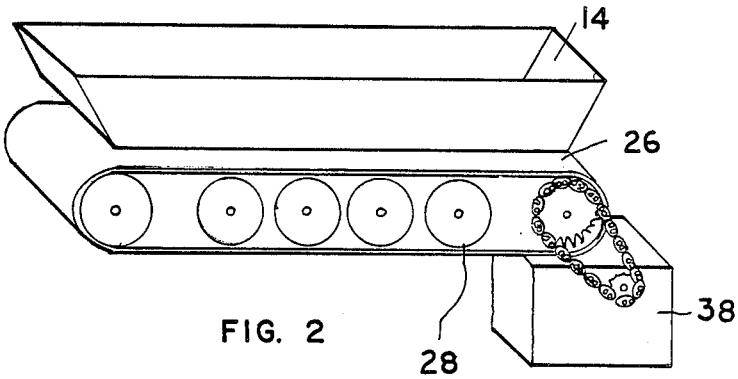
FIG. 2 is a sectional view of a chain conveyer which substantially extend from the front to the back of a overlying hopper superstructure.
Figure 3:
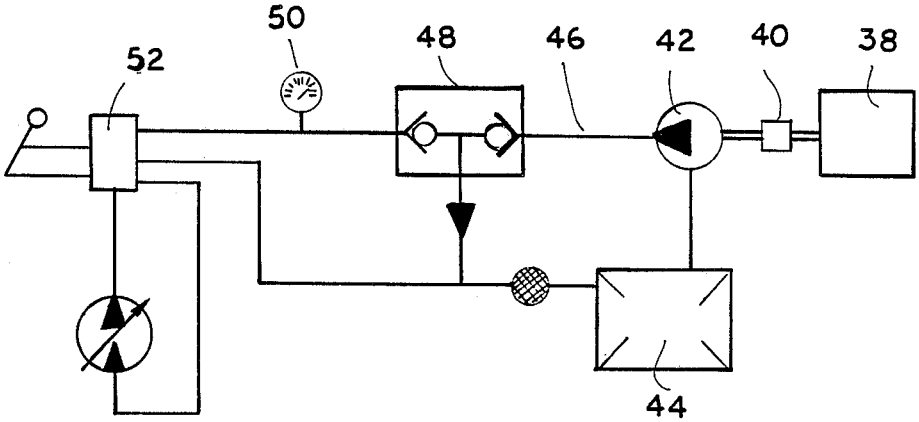
FIG. 3 is a schematic diagram of the hydraulic power drivetrain and illustrating the small gasoline engine that is used as a source of power in the drivetrain.

Hopper superstructure 12 having a front, back and side walls thereto, numbered respectively 12', 12'', 13 and 13' for the right and left side walls and having a floor member 18 overlying a chain conveyer 26 substantially as shown in FIG. 2.

As bulk material flows downward lever 24 actuated chute 19 it is deposited on chain conveyer 26 which moves the bulk materials toward exit chute 20. Chain conveyer 26 operates over a plurality of sprockets 28.

A bag 11 to be filled is suspended, open side up, under chute 20, draws closed a drawstring on the bag and ready the next for filling.

Sandbagging device 10 is mounted on a portable carriage for transport to a site and has deployed on the front portion thereof a carriage adjustment stand 34 that is affixed to carriage tongue 38. Carriage adjustment stand 34 has mechanical means 36, such as a jack mechanism, for telescopically extending the carriage adjustment stand to tilt or raise or lower the front portion of carriage 14 to assist in the displacement of wet sand or other adhesive bulk materials within hopper 12, to displace them through a slight vertical re-adjustment of the hopper superstructure 12 toward hopper floor chute 20.

Engine 39 transmits power through coupler 40 to hydraulic pump 42, which draws fluid for operation from tank 44. Pressure line 46 transmit fluid through flow control valve 48, thence to pressure gauge 50 to geardrive box 52 which mechanically drives chain conveyer 26.

Chain conveyer 26 substantially runs the length of the bottom of hopper superstructure 12, and is a length from three to seven feet and approximately 10 inches wide, allowing a sufficient volume of bulk material to be displaced thereon for the efficient filling of a successive plurality of sand bags, but without overpowering the ability of a single worker to operate the equipment.

Engine 39 is also sized for efficient operation, being approximately eleven horsepower, which through development and experiment provides the necessary power and time duration to unload bulk materials from hopper 12.

It will be apparent from the foregoing disclosure that the objects and advantages of the invention have been realized. Further, as many small changes will occur to those skilled in the art the foregoing is considered illustrative of the principles of the invention, and all equivalents thereof fall within the scope of invention.

What is claimed is:

1. A portable particulate material bagging machine mounted on a wheeled carriage, comprising:

a hopper superstructure being deployed over the wheeled carriage, said hopper superstructure having vertically inclined front walls, back walls and side walls extending downwardly to a hopper floor, said hopper floor including a lever actuated chute;

a chain conveyor; means for actuating said chain conveyor deployed under said lever actuated chute, siad chain conveyor extending longitudinally from said front wall to said back walls, said conveyor extending substantially between said walls, and having a bagger filling chute depending rearwardly therefrom; and said chain conveyor elevated within a range of two feet to four and one-half feet above road level whereby said lever actuated chute deposits particulate matter onto said chain conveyor and said chain conveyor moves said particulate material to said bagger filling chute whereby an operator deploys a bag thereunder for filling.

2. A portable particulate material bagging machine mounted on a wheeled carriage as recited in claim 1 including a carriage adjustment stand rigidly affixed to a front portion of said carriage and having means for inclining said carriage whereby said particulate material may be shifted within said hopper for the expeditious handling of said particulate material.

3. A portable sand or particulate material bagging machine mounted on a wheeled carriage as recited in claim 1 wherein said chain conveyor has a front to back length in a range from three to seven feet to provide a unit of towable size and weight when loaded that is operable by one worker.

4. A portable particulate material bagging machine mounted on a wheeled carriage as recited in claim 1, wherein said conveyor actuating means is a gasoline engine, said gasoline engine functioning to provide power to said hydraulic power train for said chain conveyor.

5. A portable sand or particulate material bagging machine mounted on a wheeled carriage as recited in claim 1 wherein said hopper superstructure is substantially balanced over a tandem wheel set whereby said hopper superstructure maintains in a level condition with respect to the road surface whereby said device is maintained in a safe, operable condition.

6. A portable particulate material bagging machine mounted on a wheeled carriage, comprising:

a hopper superstructure being depolyed over the wheeled carriage, said hopper superstructure having vertically inclined front walls, back walls and side walls extending downwardly to a hopper floor, said hopper floor including a lever actuated chute;

a chain conveyor;

means for actuating said chain conveyor deployed under said lever actuated chute, said chain conveyor extending longitudinally from said front wall to said back walls, said conveyor extending substantially between said walls, and having a bagger filling chute depending rearwardly therefrom;

said chain conveyor elevated within a range of two feet to four and one-half feet above road level whereby said lever actuated chute deposits particulate matter onto said chain conveyor and said chain conveyor moves said particualte material to said bagger filling chute whereby an operator deploys a bag thereunder for filling; and a portable carriage adjustment stand rigidly affixed to a front portion of said carriage and having telescoping jack mechanism means for inclining said carriage whereby said particulate material may be shifted within said hopper for the expeditious handling of said particulate material.

7. A portable particulate material bagging machine mounted on a wheeled carriage, comprising:

a hopper superstructure being deployed over the wheeled carriage, said hopper superstructure having vertically inclined front walls, back walls and side walls extending downwardly to a hopper floor, said hopper floor including a lever actuated chute;

a chain conveyor;

means for actuating said chain conveyor deployed under said lever actuated chute, said chain conveyor extending longitudinally from said front wall to said back walls, said conveyor extending substantially between said walls, and having a bagger filling chute depending rearwardly therefrom;

said chain conveyor elevated within a range of two feet to four and one-half feet above road level whereby said lever actuated chute deposits particulate matter onto said chain conveyor and said chain conveyor moves said particulate material to said bagger filling chute whereby an operator deploys a bag thereunder for filling;

a carriage adjustment stand rigidly affixed to a front portion of said carriage and having telescoping jack mechanism means for inclining said carriage whereby said particulate material may be shifted within said hopper for the expeditious handling of said particulate material;

said chain conveyor has a front-to-back length in a range from three to seven feet to provide a unit of towable size and weight when loaded that is operable by one worker;

said means for actuating said chain conveyor is a gasoline engine, said gasoline engine functioning to provide power to said hydraulic power train for said chain conveyor; and said hopper superstructure is substantially balanced over a tandem wheel set whereby said hopper superstructure maintains in a level condition with respect to the road surface whereby said device is maintained in a safe, operable condition.

* * * * *